US007325528B2

(12) United States Patent
Schieber et al.

(10) Patent No.: US 7,325,528 B2
(45) Date of Patent: Feb. 5, 2008

(54) METHOD OF OPERATING A SINGLE CYLINDER TWO-STROKE ENGINE

(75) Inventors: Eberhard Schieber, Backnang (DE); Heinrich Leufen, Schwaikheim (DE); Mohamed Abou-Aly, Waiblingen (DE); Hans Nickel, Weissach (DE); Heiko Rosskamp, Adelberg (DE); Jörg Schlossarczyk, Winnenden (DE); Klaus Geyer, Sulzbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 165 days.

(21) Appl. No.: 11/333,278

(22) Filed: Jan. 18, 2006

(65) Prior Publication Data

US 2006/0157006 A1 Jul. 20, 2006

(30) Foreign Application Priority Data

Jan. 18, 2005 (DE) ..... 10 2005 002 273

(51) Int. Cl.
*F02B 75/02* (2006.01)
*F02B 61/02* (2006.01)
*F02P 5/00* (2006.01)

(52) U.S. Cl. ..... 123/257; 123/73 R; 123/260; 123/406.18; 123/406.26; 123/406.53; 123/406.58

(58) Field of Classification Search ..... 123/73 R, 123/257, 260, 362, 394, 406.12, 408.18, 123/406.26, 406.53, 406.58
See application file for complete search history.

(56) References Cited

U.S. PATENT DOCUMENTS 4,991,558 A * 2/1991 Daly et al. ..... 123/481
5,097,811 A * 3/1992 Baumuller ..... 123/481
5,259,344 A * 11/1993 Huang et al. ..... 123/73 C
5,333,582 A * 8/1994 Kawamura ..... 123/254
5,732,674 A * 3/1998 Motoyama et al. ..... 123/299
5,901,673 A 5/1999 Ishikawa
6,405,701 B1 * 6/2002 Masberg et al. ..... 123/192.1
6,604,505 B2 * 8/2003 Hellmich ..... 123/305
6,675,748 B2 * 1/2004 Ancimer et al. ..... 123/27 R
6,880,525 B2 * 4/2005 Geyer et al. ..... 123/406.18
6,907,850 B2 * 6/2005 Creel ..... 123/71 R
6,912,979 B2 * 7/2005 Fleig et al. ..... 123/73 PP
7,017,537 B2 * 3/2006 Osburg et al. ..... 123/73 A

* cited by examiner

*Primary Examiner*—Stephen K. Cronin
(74) *Attorney, Agent, or Firm*—Walter Ottesen

(57) ABSTRACT

The invention is directed to a method for operating a two-stroke engine having a cylinder in which a combustion chamber is formed and which includes devices for metering fuel and supplying combustion air as well as an ignition device for igniting a mixture in the combustion chamber. In the method, fuel and combustion air are supplied to the engine and the mixture in the combustion chamber is ignited. The combustion chamber is delimited by a piston which drives a crankshaft rotatably journalled in a crankcase. A control is provided which controls the metering of fuel and the ignition of the mixture in the combustion chamber. In the method, the two-stroke engine is controlled in at least one operating state so that the number of combustions is less than the number of revolutions of the crankshaft in the same time interval.

19 Claims, 4 Drawing Sheets

METHOD OF OPERATING A SINGLE CYLINDER TWO-STROKE ENGINE

CROSS REFERENCE TO RELATED APPLICATION

This application claims priority of German patent application no. 10 2005 002 273.1, filed Jan. 18, 2005, the entire content of which is incorporated herein by reference.

FIELD OF THE INVENTION

The invention relates to a method for operating a single cylinder two-stroke engine especially in a portable handheld work apparatus such as a portable chain saw, cutoff machine or the like.

BACKGROUND OF THE INVENTION

A two-stroke engine is disclosed in U.S. Pat. No. 5,901,673 wherein fuel is injected into the combustion chamber in the region of bottom dead center with each rotation of the crankshaft and the air/fuel mixture, which forms in the combustion chamber, is ignited in the region of top dead center of the piston.

Two-stroke engines can pass into four-stroke operation especially at high rpms. This means that a combustion does not take place with each revolution of the crankshaft; instead, a combustion takes place only approximately every second revolution of the crankshaft. The four-stroke operation of the two-stroke engine takes place irregularly so that in some cycles a combustion takes place for each revolution of the crankshaft and, in other, usually in several successive, cycles a combustion takes place only every second revolution of the crankshaft. In this way, there results a rough running of the two-stroke engine which becomes manifest especially with an intensely fluctuating running noise which can be disturbing for the operator.

Above all, at low rpms and shortly after the start of the two-stroke engine when the two-stroke engine is still cold, a late combustion or a delayed combustion can occur in the combustion chamber. The late combustion in the combustion chamber leads to the situation that the pressure in the combustion chamber is increased when the transfer channels open into the combustion chamber. In this way, the pressure in the crankcase is influenced. A complete scavenging of the combustion chamber cannot take place because of the unfavorable pressure conditions. Because of the changed pressure conditions, only a reduced quantity of air/fuel mixture can pass from the crankcase into the combustion chamber. For this reason, the pressure in the crankcase is raised. In this way, the mixture preparation in a carburetor can be influenced and the ratio of fuel and combustion air is changed. Because of the changed mixture composition in the combustion chamber, the next combustion also takes place late. This late combustion disturbs the mixture preparation for the next combustion cycle so that a permanent disturbance of the running performance of the two-stroke engine results.

SUMMARY OF THE INVENTION

It is an object of the invention to provide a method for operating a two-stroke engine with which a smooth running performance of the two-stroke engine can be achieved in a simple manner.

The method of the invention is for operating a single cylinder two-stroke engine. The two-stroke engine includes:

a cylinder; a piston mounted in the cylinder to undergo a reciprocating movement along a stroke path between top dead center and bottom dead center during the operation of the engine; the cylinder and the piston conjointly delimiting a combustion chamber; a crankcase connected to the cylinder; a crankshaft rotatably mounted in the crankcase; the piston being connected to the crankshaft for imparting rotational movement to the crankshaft; a device for metering fuel to the engine and a device for supplying air to the engine; an ignition unit for igniting an air/fuel mixture in the combustion chamber; and, a control unit controlling the metering of the fuel and the ignition of the mixture in the combustion chamber; the method including the step of controlling the two-stroke engine in at least one operating state so as to cause the number of combustions to be less than the number of revolutions of the crankshaft in the same time interval.

A quiet, pleasant running performance of the two-stroke engine can be achieved in a simple manner via the control of the number of combustions referred to the number of revolutions of the crankshaft. The control inputs at which cycles a combustion should take place. In this way, the two-stroke engine cannot drop uncontrolled and irregularly into a four-stroke operation. With a delayed combustion in the combustion chamber, it is the suppression of the combustion for at least one cycle which achieves the condition that the combustion chamber is well scavenged and the pressure level in the crankcase can be reduced to a normal level. A good mixture preparation can take place in the carburetor and the combustion no longer takes place delayed. The two-stroke engine is so controlled that the number of combustions is less than the number of revolutions of the crankshaft, that is, a combustion cannot take place for each revolution of the crankshaft.

It is advantageous to so control the two-stroke engine that the number of combustions is in a ratio of 1 to 2 up to 1 to 8 to the number of revolutions of the crankshaft. In this way, a pleasant, uniform running performance of the two-stroke engine can be achieved. A low combustion frequency, for example, a ratio of the number of combustions to the number of revolutions of the crankshaft from 1 to 6 up to 1 to 8 is especially provided for an engine having a large centrifugal mass. The number of combustions is advantageously controlled in accordance with a pregiven pattern. The pattern in accordance with which the control takes place has especially a stochastic component. In this way, it is prevented that the two-stroke engine can settle into a frequency. A running performance of the two-stroke engine, which is pleasant for the operator, can be achieved via irregularities which are caused by the stochastic component of the pattern.

Advantageously, the number of combustions is so controlled that a pleasant running noise of the two-stroke engine results. The running noise for a two-stroke engine can be adjusted via the adaptation of the ratio of the number of combustions to the number of revolutions of the crankshaft. Here, the ratio can be differently selected in different operating states of the internal combustion engine. A desired running noise can be adjusted in a simple manner via an adaptation of the ratio of the number of combustions to the number of revolutions of the crankshaft. It is provided that the number of combustions is so controlled that a stable running performance of the two-stroke engine results. A stable running performance is especially necessary in operating states wherein there is a danger for a delayed combustion in the combustion chamber and the disturbance of the running performance of the two-stroke engine associated therewith exists. In order to obtain a stable running performance, the two-stroke engine is so controlled that a combustion takes place for each second revolution of the crankshaft. In this way, a uniform four-stroke operation is imposed on the two-stroke engine which ensures a correctly timed combustion and a good mixture preparation.

The number of combustions is controlled via the control of the fuel metering. No fuel is metered to the two-stroke engine especially for the revolutions of the crankshaft for which no combustion should take place. In this way, the running noise can be influenced by the suppression of the fuel metering. For this purpose, no special devices are needed so that even for existing two-stroke engines, only the control must be appropriately equipped. Changes on the two-stroke engine itself are not necessary. Influencing of the running noise can also be achieved in a simple manner in that the ignition is suppressed for the revolutions of the crankshaft wherein no combustion is to take place. The ignition can be suppressed in addition to the metering of fuel.

It can, however, be practical to continue to meter fuel to the two-stroke engine and exclusively suppress the ignition. This can be advantageous when an adequate fuel metering and/or an adequate lubrication of the two-stroke engine cannot be ensured in any other way. With a suppression of the fuel metering, it is provided that, for the revolutions of the crankshaft wherein fuel is metered, a quantity of fuel is metered which is increased compared to a fuel metering at each crankshaft revolution. Advantageously, and compared to the fuel metering for each crankshaft revolution, approximately 1.5 times to 5 times the fuel quantity is metered. Accordingly, the fuel quantity, which is injected in a cycle, is greater; however, overall, a lesser fuel consumption results because, for example, for each second crankshaft revolution, 1.5 times the fuel quantity, or for each third crankshaft revolution, twice the fuel quantity, is metered. In this way, the fuel consumption of the two-stroke engine overall and therefore also the exhaust-gas values can be reduced.

The acceleration of the crankshaft is measured. The metered fuel quantity is controlled especially in dependence upon the measured acceleration of the crankshaft. Accordingly, for an acceleration of the crankshaft, which is too low, the fuel quantity can be increased and correspondingly, at an acceleration, which is too high, the metered fuel quantity can be reduced. A rapid adaptation of the rpm and therefore a simple possibility of rpm stabilization can be achieved when the number of combustions is controlled in dependence upon the measured acceleration of the crankshaft. In a simple manner, an rpm stabilization can be achieved via the control of the metered fuel quantity and the control of the number of combustions. This rpm stabilization likewise leads to a quiet running noise of the two-stroke engine.

Because of the missed ignition or the unfavorable distribution of the fuel in the combustion chamber, the situation can arise that no complete combustion takes place for a revolution of the crankshaft for which a combustion should take place notwithstanding the fuel metering and ignition of the mixture. The incomplete combustion manifests itself in an inadequate acceleration of the crankshaft. Fuel is metered anew for the following revolution of the crankshaft when an acceleration of the crankshaft does not take place. In this way, the combustion, which did not take place, can be made up in the following cycle and so a pleasant running noise can be achieved.

The operating state wherein the two-stroke engine is so controlled that the number of combustions is less than the number of revolutions of the crankshaft in the same time interval is especially the full load operation. Advantageously, a pleasant running noise can be obtained, however, also in idle operation by a reduction of the number of combustions. The exhaust-gas values can also be reduced hereby in idle operation. The running performance of the two-stroke engine can be stabilized with the reduction of the number of combustions, especially by the operation of the two-stroke engine in idle in a four-stroke operation. Preferably, the number of combustions is reduced after the start of the two-stroke engine also over a pregiven duration of operation. In this operating state, the two-stroke engine runs warm. A delayed combustion in the combustion chamber can occur in this state. A reduction of the number of combustions is provided in order to prevent the situation that the delayed combustion continues unabated because of the increased crankcase pressure level and the disturbed mixture preparation. Preferably, for each second revolution of the crankshaft, a combustion takes place so that the two-stroke engine is operated in four-stroke operation and, in the cycle which lies between two combustions, a good scavenging of the combustion chamber and a reduction of the pressure level in the crankcase can occur. It can, however, also be advantageous to reduce the number of combustions still further. Preferably, the operating state in which the two-stroke engine is so controlled that the number of combustions is less than the number of revolutions of the crankshaft in the same time interval is fixedly pregiven. In the operating states wherein the combustion often takes place delayed, as in idle operation or after starting of the two-stroke engine, a lower number of combustions are accordingly provided ab initio.

Likewise, in operating states wherein the engine drops into an uncontrolled four-stroke operation such as at full load operation or at idle, the number of combustions is reduced. In this way, no complex measures for detecting the time point of the combustion or of an irregular running performance of the two-stroke engine are necessary because the operating states wherein the number of combustions are reduced are fixedly pregiven. It can, however, also be advantageous that sensors are provided for detecting parameters of the engine which are characterizing for the running performance. Here, for example, the time point of the combustion or whether a combustion has taken place can be detected. In this case, a reduction of the number of combustions results only when a rough running of the two-stroke engine is present.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
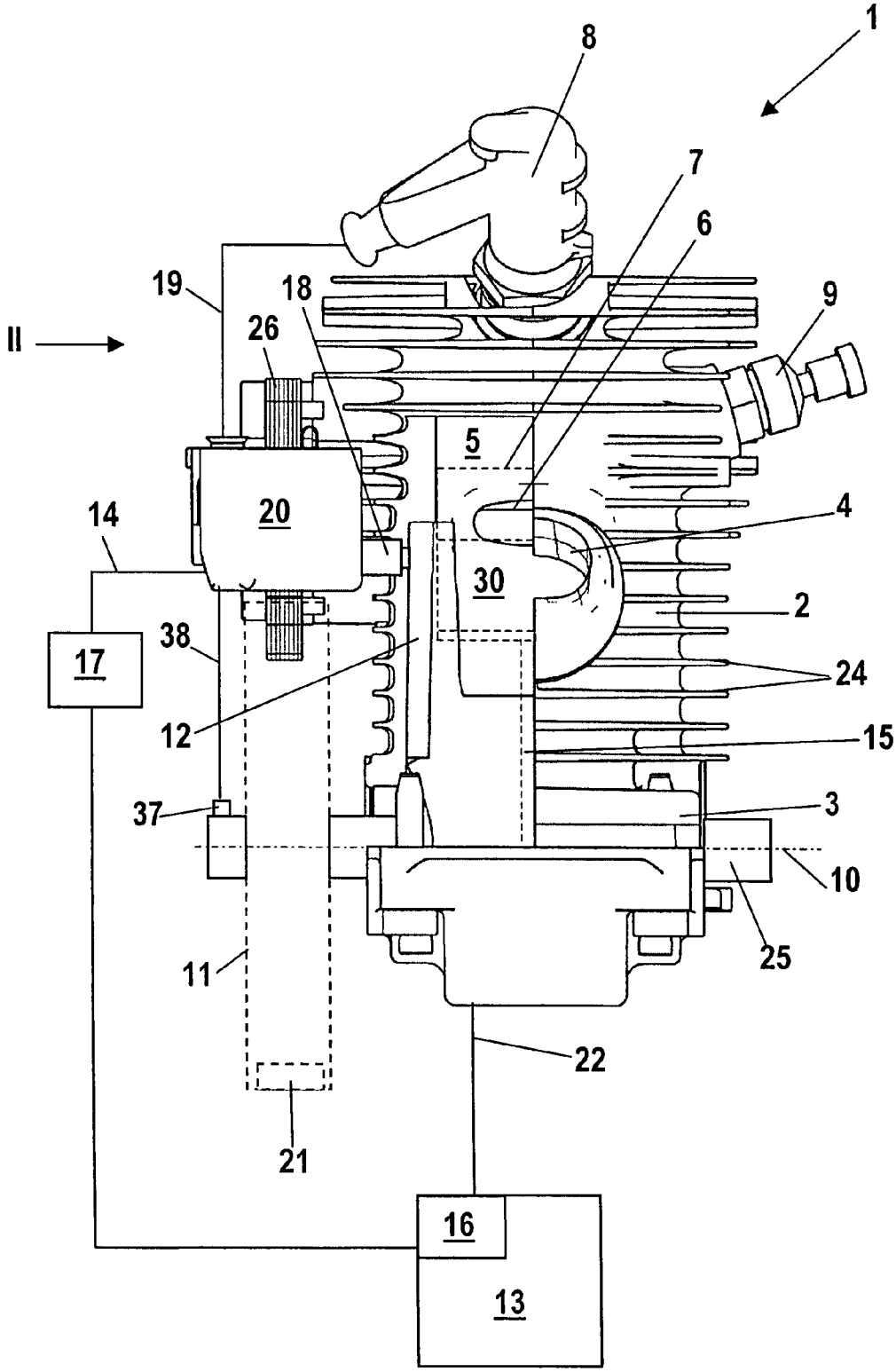
FIG. 1 is a schematic side elevation view of a two-stroke engine which draws in substantially fuel-free air via a piston pocket.

The two-stroke engine 1 shown in FIG. 1 has a cylinder 2 having cooling ribs 24 arranged on the outer surface thereof. A piston 7 is reciprocally journalled in the cylinder 2 and is shown in phantom outline. The piston 7 drives a crankshaft 25 via a connecting rod 15. The crankshaft 25 is rotatably journalled in a crankcase 3 about the crankshaft axis 10. An inlet 4 opens on the cylinder 2 via which substantially fuel-free combustion air is supplied to the two-stroke engine which is configured as a single cylinder engine.

The two-stroke engine includes at least one transfer channel 12 which connects the crankcase 3 to a combustion chamber 5 in the region of bottom dead center of the piston 7. The combustion chamber 5 is delimited by the cylinder 2 and the piston 7. Two or four transfer channels 12 are provided and are arranged symmetrically with respect to a partitioning center plane centered with respect to the inlet 4. The piston 7 has a piston pocket 30 indicated in phantom outline in FIG. 1. Two piston pockets 30 can also be provided arranged on both sides of the inlet 4. The air channel can open into the transfer channels via one or several check valves, especially membrane valves. The piston pocket 30 connects the inlet 4 to the transfer channel 12 in the region of top dead center of the piston 7 so that the combustion air flows via the inlet 4 and the piston pocket 30 into the transfer channel 12 and from there into the crankcase 3. In this way, the transfer channel 12 is completely scavenged with substantially fuel-free combustion air. A decompression valve 9 can be mounted in the cylinder 2 via which the combustion chamber 5 can be vented to facilitate starting of the two-stroke engine. A spark plug 8 is mounted on the cylinder 2 and projects into the combustion chamber 5. An outlet 6 leads out from the cylinder 2 through which the exhaust gases can flow out of the combustion chamber 5.

A valve 18 is provided for metering fuel and is especially configured as an electromagnetic valve. The valve 18 can, however, also be integrated on an injection nozzle. The valve 18 is integrated in an ignition module 20. The valve 18 is controlled by a control unit, for example, a central control unit (CPU) which is arranged in the ignition module 20. The ignition module 20 controls the ignition of the spark plug 8 via a lead 19. A magnet 21 is mounted on the crankshaft 25 for generating the ignition energy. More specifically, the magnet 21 is mounted on a fan wheel 11 which, in turn, is mounted on the crankshaft so as to rotate therewith.

Figure 2:
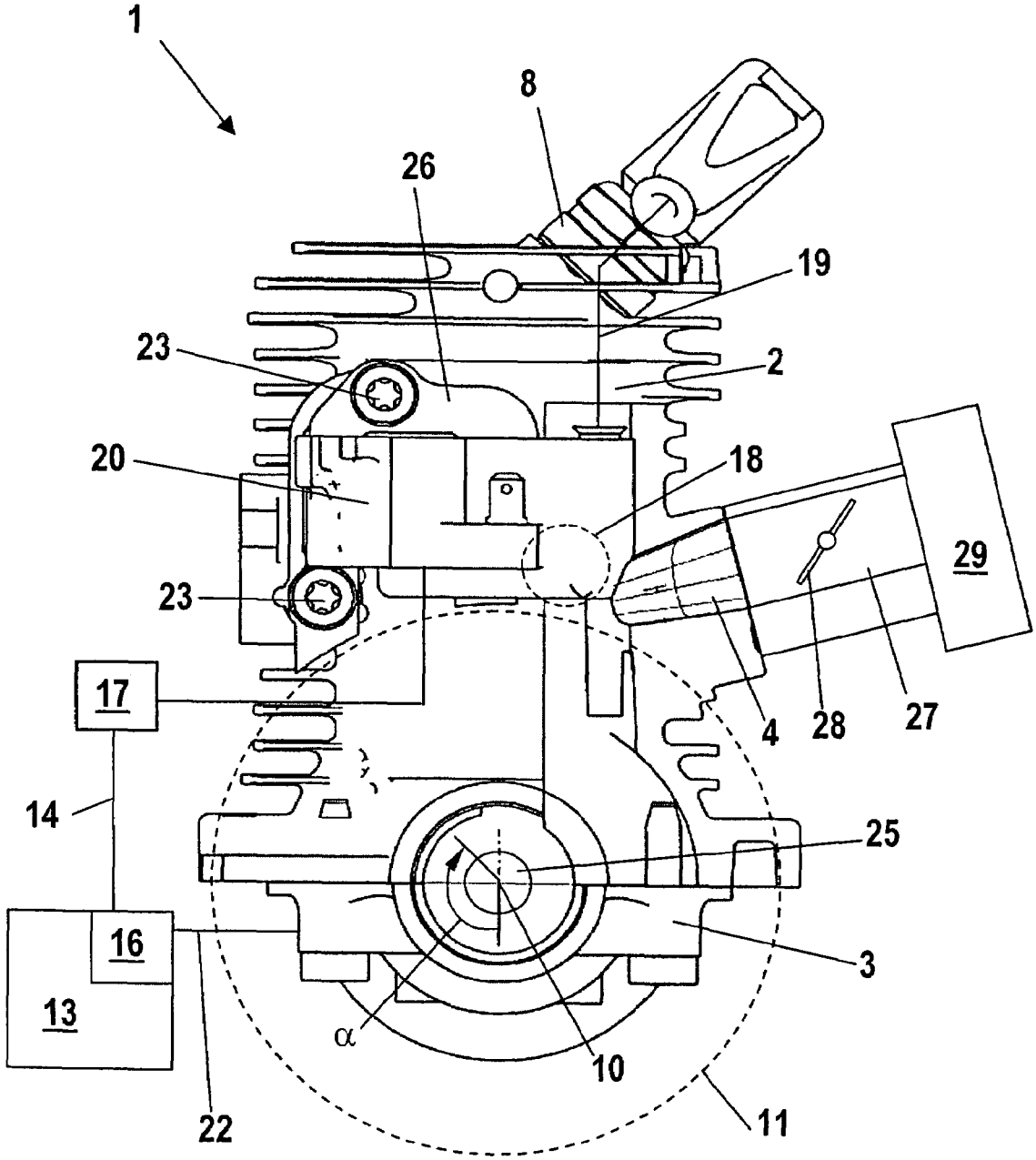
FIG. 2 is a side elevation view of the two-stroke engine of FIG. 1 viewed in the direction of arrow II of FIG. 1.

As shown in FIG. 2, a sheet metal packet 26 with an ignition coil (not shown) is mounted on the ignition module 20 at the periphery of the fan wheel 11. The magnet 21 induces a voltage in the ignition coil which generates the ignition spark in the spark plug 8. The ignition module 20 is attached to the cylinder 2 via threaded fasteners 23.

The electromagnetic valve 18 is integrated on the ignition module 20 and is connected via a fuel line 14 to the fuel pump 16 mounted in the fuel tank 13. The fuel pump 16 can be configured as a membrane pump and is driven by the fluctuating crankcase pressure. For this purpose, the fuel pump 16 is connected via a pulse line 22 to the crankcase 3. The fuel pump 16 pumps the fuel from the fuel tank 13 into a fuel store 17 from where it arrives at the electromagnetic valve 18. A pressure control valve can be mounted in the fuel store 17 and this valve can be connected via a return line to the fuel tank.

As shown in FIG. 2, the combustion air, which is supplied to the two-stroke engine 1 via the inlet 4, is drawn by suction via a filter 29 as well as an air channel 27. In the air channel 27, a throttle flap 28 is mounted for controlling the supplied air quantity.

During operation of the two-stroke engine 1, substantially fuel-free combustion air is drawn by suction in the region of top dead center of the piston 7 from the inlet 4 via the piston pocket 30 and the transfer channel 12 into the crankcase 3 (FIG. 1). To lubricate the crankcase 3, the valve 18 conducts a fuel/oil mixture (which is typical for a two-stroke engine) to the combustion air at the start of the induction phase. The fuel/oil mixture is conveyed by the combustion air into the crankcase 3 and the transfer channel 12 is thereafter substantially completely filled with fuel-free air. The fuel/oil mixture and the combustion air are compressed with the downward stroke of the piston 7 in the crankcase 3. As soon as the piston 7 opens the transfer channel 12 toward the combustion chamber 5 (FIG. 1), first fuel-free air and thereafter fuel/oil/air mixture flows from the crankcase 3 into the combustion chamber 5.

In the subsequent upward stroke of the piston 7, the mixture is compressed in the combustion chamber 5 and, controlled by the control unit integrated at the ignition module 20, is ignited by the spark plug 8. The ignited mixture expands with the combustion so that the piston 7 is pressed in the direction toward the crankcase 3. The exhaust gases flow through the outlet 6 from the combustion chamber 5 and are scavenged or expelled by the substantially fuel-free air after flowing through the transfer channel 12.

The two-stroke engine 1 passes intermittently into a four-stroke operation especially at high rpms. This means that a combustion of the mixture takes place in the combustion chamber 5 every second revolution of the crankshaft 25. A rough running noise results because the two-stroke engine combusts the mixture irregularly each or every second revolution of the crankshaft 25. To generate a quiet, pleasant running noise of the two-stroke engine, the two-stroke engine 1 is so controlled in at least one operating state, especially at full load operation, that the number of combustions is less than the number of revolutions of the crankshaft 25. The two-stroke engine 1 is then so controlled that a pleasant running noise results.

In full load operation of the two-stroke engine 1, combustion air from the inlet 4 is drawn by suction via the piston pocket 30 and the transfer channel 12 into the crankcase 3 in the region of top dead center of the piston 7 (FIG. 1). In this phase, an injection of fuel for lubricating the crankcase takes place. The combustion air is compressed in the crankcase 3 during the downward stroke of the piston 7 and flows via the transfer channel 12 into the combustion chamber 5 as soon as the transfer channel 12 opens toward the combustion chamber 5. After a portion of the combustion air has passed into the combustion chamber 5, fuel is injected via the electromagnetic valve 18 into the combustion air flowing through the transfer channel 12. The fuel enters the combustion chamber 5. There, the fuel is compressed during the upward stroke of the piston 7 and is ignited by the spark plug 8. Thereafter, the combusting mixture expands in the combustion chamber 5 and presses the piston 7 toward the crankcase 3. The exhaust gases flow out through the outlet 6. In the region of top dead center of the piston 7, combustion air for the next cycle is drawn by suction through the inlet 4. With the downward movement of the piston 7, the combustion air passes from the crankcase 3 via the transfer channel 12 into the combustion chamber 5. However, in this cycle, no fuel is added to the combustion air so that no combustion can take place in the combustion chamber 5 and the combustion chamber 5 is scavenged or flushed with substantially fuel-free air. However, a small quantity can be metered, for example, for lubrication. The fuel quantity is then so controlled that no ignitable mixture arises in the combustion chamber 5. Also, no ignition need take place via the spark plug 8. The air leaves the combustion chamber 5 via the outlet 6. At full load operation, it is provided that a combustion only takes place approximately every second to every eighth crankshaft revolution.

In lieu of so controlling the two-stroke engine 1 that the fuel metering in the cycles, in which no combustion is to take place, is suppressed or reduced, the ignition of the two-stroke engine 1 can be simply suppressed. Advantageously, the ignition as well as the metering of fuel is suppressed in cycles wherein no combustion should take place so that, in these cycles, a scavenging of the combustion chamber 5 with substantially fuel-free air takes place so that low exhaust-gas values result. The energy, which is stored for the ignition of the spark plug in the ignition module 20, can be intermediately stored over several revolutions of the crankshaft 25 so that the energy, which is available for ignition, can be increased.

The metering of fuel takes place especially in a clocked manner when the number of combustions is controlled via the control of the metering of fuel. The fuel quantity, which is supplied approximately every second to every eighth crankshaft revolution, is, however, increased compared to a fuel metering which takes place for each crankshaft revolution. Advantageously, approximately 1.5 times to 5 times the fuel quantity is metered. In order to ensure that a combustion takes place every second to every eighth crankshaft revolution, monitoring takes place as to whether an acceleration of the crankshaft 25 takes place in order to determine whether the mixture in the combustion chamber 5 has been ignited and combusted. For this purpose, the time interval between ignition pulses is determined via the rotating magnet 21 by the central control unit (CPU). Here, however, the rotational speed of the crankshaft 25 can, for example, also be measured. For measuring the rotational speed of the crankshaft, the sensor 37 shown in FIG. 1 is provided which is connected via the line 38 to the control integrated into the ignition module 20. When a combustion of the mixture or an acceleration of the crankshaft does not take place, then fuel is metered anew with the next revolution of the crankshaft and/or the mixture is ignited. This takes place via the control integrated into the ignition module 20. If the acceleration exceeds a pregiven value which, for example, can be dependent upon the desired rpm, then the time interval to the next fuel metering is lengthened by the CPU in a controlled manner. The rpm can be stabilized in this way. In addition, to stabilize the rpm, the fuel quantity metered per cycle can be varied. A simple stabilization of the rpm is possible with a variation of the time interval between two successive meterings of fuel and the respective metered quantities of fuel. The stabilization of the rpm leads to a quiet, pleasant running noise of the two-stroke engine 1.

It can be advantageous to control the running noise of the two-stroke engine 1 in idle operation in that the number of combustions is selected to be less than the number of revolutions of the crankshaft 25 in the same time interval. With the control of the number of combustions during idle operation, the exhaust-gas values, which adjust in idle operation, can be significantly reduced with the control via the metering of fuel. Especially at idle, the idle rpm can be stabilized via the control of the number of combustions. At idle, the fuel is injected into the transfer channel 12 especially during the flow of combustion air from the crankcase 3 into the combustion chamber 5. A metering of fuel to the crankcase 3 for lubricating the crankshaft 25 is not necessary.

During idle operation and during a pregiven time interval after the start of the two-stroke engine while the two-stroke engine runs warm, it is provided that the number of combustions is selected to be less than the number of revolutions of the crankshaft 25 in the same time interval. Especially in these operating states, the danger is present of a delayed combustion in the combustion chamber. The delayed combustion leads to an increased pressure level in the crankcase and to an incomplete scavenging of the combustion chamber. With the incomplete scavenging, a combustion is initiated with delay in the next cycle so that the disturbance continues. This can be avoided via a suppression of the combustion, preferably, every second cycle. The two-stroke engine is accordingly driven in four-stroke operation. The combustion can be prevented by suppressing the ignition and/or by suppressing the metering of fuel. Preferably, the operating states wherein the number of combustions are reduced are fixedly pregiven. In this way, devices for detecting a rough running of the two-stroke engine can be omitted. However, it can also be provided that units are provided for determining the running performance of the two-stroke engine and the number of combustions are reduced only in the operating states wherein the running performance is actually not smooth.

Figure 4:
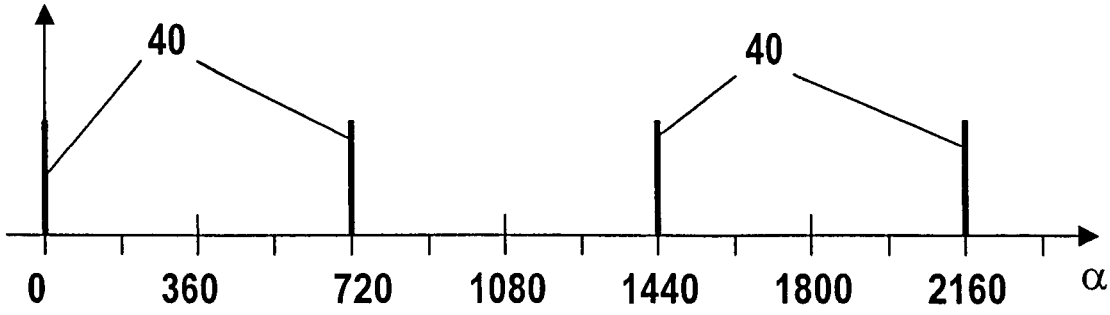
Figure 5:
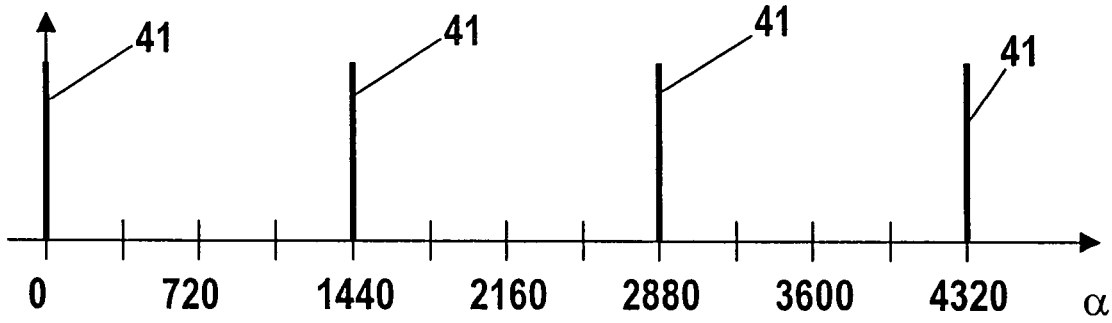
Figure 6:
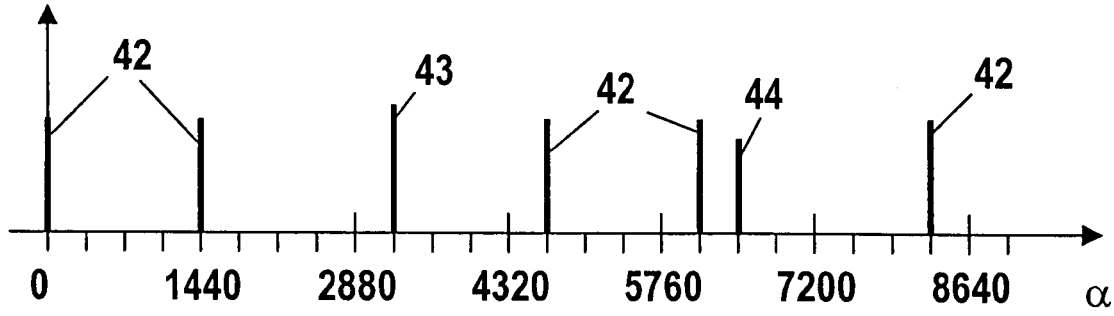

In FIGS. 4 to 6, the metering of fuel is plotted as a function of crankshaft angle ($\alpha$) (FIG. 2). For the clocking of the metering of fuel shown in FIG. 4, the metering of fuel takes place in a clocked manner every two revolutions of the crankshaft.

The start of the fuel injection accordingly takes place each time after 720° crankshaft angle ($\alpha$). The injection of fuel is indicated by the bars 40 in FIG. 4. A metering of fuel takes place every two revolutions of the crankshaft and the metered fuel quantity is, in each case, constant. In this way, a four-stroke operation is imposed upon the two-stroke engine 1 by a targeted control so that the two-stroke engine 1 cannot pass uncontrolled intermittently into the four-stroke operation. A pleasant running noise of the two-stroke engine 1 results because of the imposed four-stroke operation. At idle, and when the engine is running warm, a complete scavenging of the combustion chamber is obtained via the imposed four-stroke operation and a delayed combustion is avoided. Especially in two-stroke engines, wherein the mixture preparation takes place in a carburetor, a disturbance of the mixture preparation can be avoided by the timely combustion.

FIG. 5 shows a diagram of the metering of fuel wherein the fuel metering takes place every four revolutions of the crankshaft 25. The metering is indicated by the bars 41. The fuel metering takes place in a cycle at a distance of 1440° crankshaft angle ($\alpha$) from the start of the previous metering of fuel.

For the clocking indicated schematically in FIG. 6, the metering of fuel (that is, for example, the fuel injection) takes place every four crankshaft revolutions, that is, after 1440° crankshaft angle ($\alpha$). This is indicated by the bars 42. A stochastic lengthening or shortening of the interval is superposed on this constant clocking by the CPU between two successive fuel meterings for stabilizing the rpm and influencing of the running noise. Accordingly, the fuel metering, which is indicated by bar 43, does not take place already after a crankshaft angle ($\alpha$) of 2880°, but only after 3240°, that is, one revolution of the crankshaft 25 later. To reduce the instantaneous rpm after a suppressed ignition or after a combustion, which does not take place, the fuel metering, which is indicated by bar 44, does not take place in an interval of 1440° crankshaft angle ($\alpha$) to the preceding fuel metering, that is, not at 7560° crankshaft angle ($\alpha$) but already three revolutions of the crankshaft earlier, namely, at a crankshaft angle (α) of 6480°. In this way, a short term increase in rpm is obtained. Accordingly, only one revolution of the crankshaft 25 lies between the metering of fuel (indicated by the bar 44) and the previous metering of fuel. The pregiven pattern of the combustion is made up of the constant component of a combustion, which takes place every four revolutions of the crankshaft 25, as well as a superposed stochastic component. The stochastic component prevents that the two-stroke engine can oscillate into a fixed frequency which can lead to a further unwanted noise development and/or vibration development.

As indicated in FIG. 6, the metered fuel quantity can be adapted in the cycles also via a shortened or lengthened clocking. For a shortened clocking, less fuel is accordingly metered and for a lengthened clocking, more fuel is metered. However, it can also be advantageous to meter the same quantity of fuel at each clock cycle.

An ignition of the mixture takes place only in the engine cycles wherein the electromagnetic valve 18 has metered fuel. For this purpose, the ignition module 20 can have a unit for storage, for example, a capacitor wherein the energy is stored which is induced in the ignition coil over several revolutions of the crankshaft 25. The ignition spark, which is generated by the spark plug 8, can thereby be maintained over a longer time interval. In this way, it can be ensured that for each wanted ignition by the spark plug 8, the mixture, which is disposed in the combustion chamber 5, is actually combusted.

Figure 3:
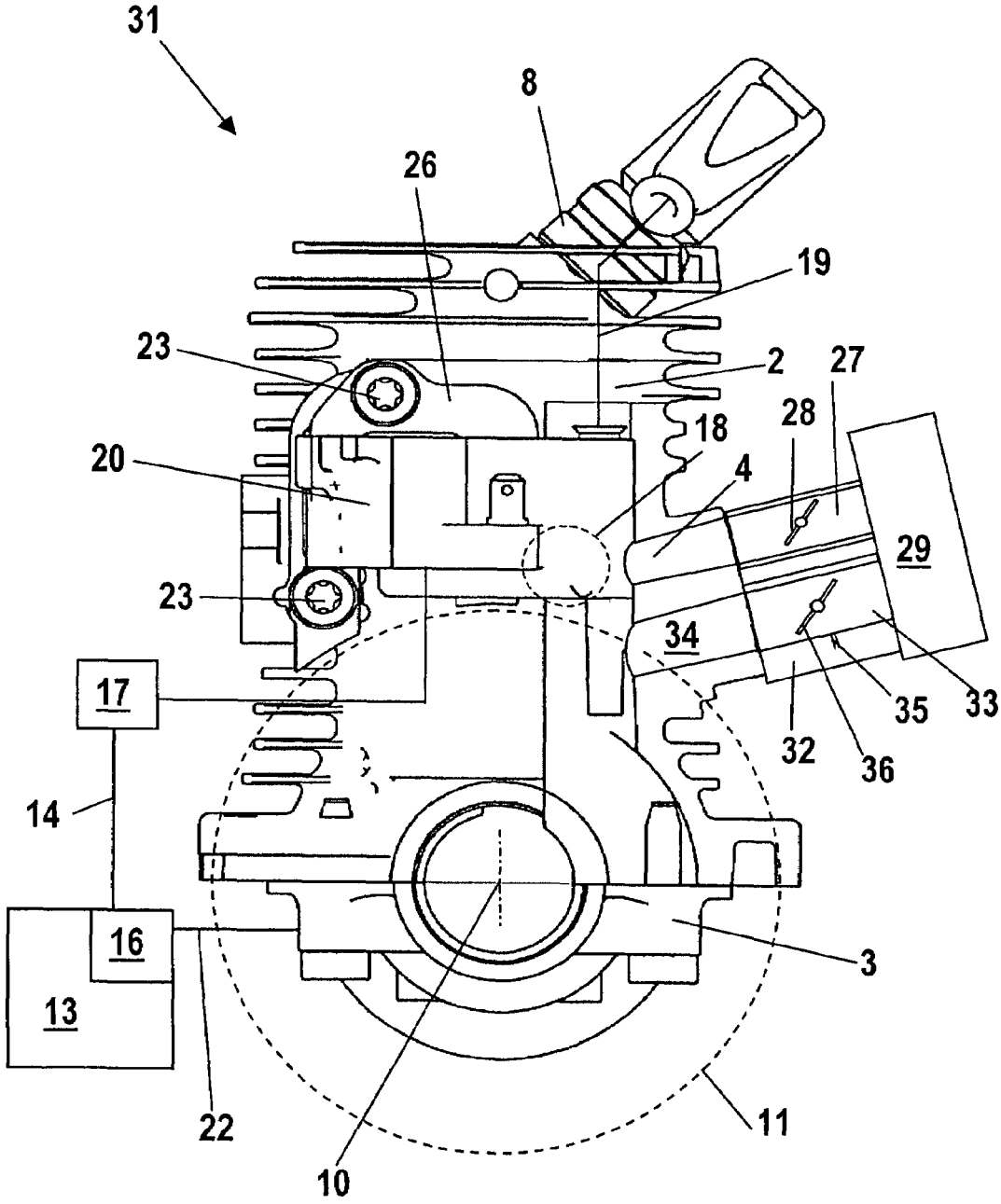
FIG. 3 is a schematic of a two-stroke engine having a scavenging-advance function; and, FIGS. 4 to 6 are diagrams showing the combustion as a function of crankshaft angle.

In FIG. 3, an embodiment of a single cylinder two-stroke engine 31 is shown. The same reference numerals identify the same components as in FIGS. 1 and 2. The two-stroke engine 31 has an inlet 4 for substantially fuel-free air as well as a mixture inlet 34. At the mixture inlet 34, a carburetor 32 is mounted which is shown schematically in FIG. 3. In the carburetor 32, a throttle unit is mounted which here is a pivotally journalled throttle flap 36. A fuel opening 35 opens into the mixture channel 33 formed in the carburetor 32 in the region of the throttle flap 36. Fuel is metered to the mixture channel 33 via the fuel opening 35. At least a portion of the fuel is supplied via the carburetor 32 in the full load operation of the two-stroke engine 31. During idle operation, the metering of fuel takes place via the valve 18 integrated at the ignition module 20. In this way, a lubrication of the crankcase 3 at full load operation is achieved in a simple manner. At the same time, an adequate fuel supply is ensured.

The fuel metering can also take place via a valve, which is mounted on the crankcase, or another unit for metering fuel. The running performance, especially the development of noise, is influenced only by the control of the two-stroke engine. For this reason, the running performance in existing two-stroke engines can be influenced by changing the control.

It is understood that the foregoing description is that of the preferred embodiments of the invention and that various changes and modifications may be made thereto without departing from the spirit and scope of the invention as defined in the appended claims.

What is claimed is:

1. A method of operating a single cylinder two-stroke engine, the two-stroke engine including: a cylinder; a piston mounted in said cylinder to undergo a reciprocating movement along a stroke path between top dead center and bottom dead center during the operation of said engine; said cylinder and said piston conjointly delimiting a combustion chamber; a crankcase connected to said cylinder; a crankshaft rotatably mounted in said crankcase; said piston being connected to said crankshaft for imparting rotational movement to said crankshaft; a device for metering fuel to said engine and a device for supplying air to said engine; an ignition unit for igniting an air/fuel mixture in said combustion chamber; and, a control unit controlling the metering of said fuel and the ignition of said mixture in said combustion chamber; the method comprising the step of:

controlling said two-stroke engine in at least one operating state so as to cause the number of combustions to be less than the number of revolutions of the crankshaft in the same time interval;

wherein the number of combustions is controlled pursuant to a pregiven pattern; and, wherein said pregiven pattern includes a stochastic component.

2. The method of claim 1, comprising the further step of so controlling said two-stroke engine that the number of the combustions to the number of revolutions of said crankshaft is in a ratio range of one to two to one to eight.

3. The method of claim 1, wherein the ignition is suppressed for the revolutions of the crankshaft wherein no combustion is to take place.

4. The method of claim 1, wherein an operating state is the idle operating state when said two-stroke engine is so controlled that the number of combustions is less than the number of revolutions of the crankshaft in the same time interval.

5. The method of claim 1, wherein an operating state is present for a pregiven time duration after the start of the two-stroke engine in which the two-stroke engine is so controlled that the number of combustions is less than the number of revolutions of the crankshaft in the same time interval.

6. The method of claim 1, wherein an operating state is always fixedly pregiven wherein the two-stroke engine is so controlled that the number of combustions is less than the number of revolutions of the crankshaft in the same time interval.

7. The method of claim 1, wherein the running performance of the two-stroke engine is determined and the number of combustions are reduced only in operating states wherein the running performance is not smooth; and, said two-stroke engine is so controlled that the number of combustions is less than the number of revolutions of said crankshaft only when there is a rough running of said two-stroke engine.

8. The method of claim 1, wherein the number of combustions is controlled via the control of the fuel metering.

9. The method of claim 8, wherein no fuel is metered to said two-stroke engine for revolutions of the crankshaft for which no combustion should take place.

10. The method of claim 9, wherein, for revolutions of the crankshaft for which fuel is metered, a fuel quantity is metered which is increased relative to a fuel metering for each crankshaft revolution.

11. The method of claim 10, wherein approximately 1.5 times to 5 times the fuel quantity is metered compared to the fuel metering for each crankshaft revolution.

12. The method of claim 1, wherein the acceleration of the crankshaft is measured.

13. The method of claim 12, wherein the supplied quantity of fuel is controlled in dependence upon the measured acceleration of the crankshaft.

14. The method of claim 12, wherein the number of combustions is controlled in dependence upon the measured acceleration of the crankshaft.

15. The method of claim 12, wherein fuel is metered anew when a revolution of said crankshaft occurs which follows a revolution of said crankshaft for which an ignition of the mixture did not take place.

16. A method of operating a single cylinder two-stroke engine, the two-stroke engine including: a cylinder; a piston mounted in said cylinder to undergo a reciprocating movement along a stroke path between top dead center and bottom dead center during the operation of said engine; said cylinder and said piston conjointly delimiting a combustion chamber; a crankcase connected to said cylinder; a crankshaft rotatably mounted in said crankcase; said piston being connected to said crankshaft for imparting rotational movement to said crankshaft; a device for metering fuel to said engine and a device for supplying air to said engine; an ignition unit for igniting an air/fuel mixture in said combustion chamber; and, a control unit controlling the metering of said fuel and the ignition of said mixture in said combustion chamber; the method comprising the steps of:

controlling said two-stroke engine in at least one operating state so as to cause the number of combustions to be less than the number of revolutions of the crankshaft in the same time interval; and, so controlling the number of combustions that said two-stroke engine does not go irregularly into a four-stroke operation whereby a pleasant running noise of said two-stroke engine results.

17. A method of operating a single cylinder two-stroke engine, the two-stroke engine including: a cylinder; a piston mounted in said cylinder to undergo a reciprocating movement along a stroke path between top dead center and bottom dead center during the operation of said engine; said cylinder and said piston conjointly delimiting a combustion chamber; a crankcase connected to said cylinder; a crankshaft rotatably mounted in said crankcase; said piston being connected to said crankshaft for imparting rotational movement to said crankshaft; a device for metering fuel to said engine and a device for supplying air to said engine; an ignition unit for igniting an air/fuel mixture in said combustion chamber; and, a control unit controlling the metering of said fuel and the ignition of said mixture in said combustion chamber; the method comprising the steps of:

controlling said two-stroke engine in at least one operating state so as to cause the number of combustions to be less than the number of revolutions of the crankshaft in the same time interval; and, controlling the number of combustions to reduce rpm fluctuations whereby a stable running performance of said two-stroke engine results.

18. The method of claim 17, wherein said two-stroke engine is so controlled that a combustion takes place for each second revolution of said crankshaft.

19. A method of operating a single cylinder two-stroke engine, the two-stroke engine including: a cylinder; a piston mounted in said cylinder to undergo a reciprocating movement along a stroke path between top dead center and bottom dead center during the operation of said engine; said cylinder and said piston conjointly delimiting a combustion chamber; a crankcase connected to said cylinder; a crankshaft rotatably mounted in said crankcase; said piston being connected to said crankshaft for imparting rotational movement to said crankshaft; a device for metering fuel to said engine and a device for supplying air to said engine; an ignition unit for igniting an air/fuel mixture in said combustion chamber; and, a control unit controlling the metering of said fuel and the ignition of said mixture in said combustion chamber; the method comprising the step of:

controlling said two-stroke engine in at least one operating state so as to cause the number of combustions to be less than the number of revolutions of the crankshaft in the same time interval; and, wherein an operating state is the full load operating state when the two-stroke engine is so controlled that the number of combustions is less than the number of revolutions of the crankshaft in the same time interval.

* * * * *